United States Patent [19]

Albert et al.

[11] Patent Number: 4,496,285

[45] Date of Patent: Jan. 29, 1985

[54] RECIPROCATING DRIVE AND VELOCITY CONTROL FOR LONG STROKE WELL PUMPING UNIT

[75] Inventors: James W. Albert; Weems D. Turner, both of Houston, Tex.

[73] Assignee: Baker ProLift, Inc., Houston, Tex.

[21] Appl. No.: 527,738

[22] Filed: Aug. 30, 1983

[51] Int. Cl.[3] ..... F04B 49/00

[52] U.S. Cl. ..... 417/12; 417/17; 417/42; 74/89.22

[58] Field of Search ..... 417/1, 12, 17, 22, 24, 417/42, 44, 45, 448; 74/89.22, 89.21; 318/463, 464, 466, 468

[56] References Cited

U.S. PATENT DOCUMENTS

| | | | |
|---|---|---|---|
| 1,970,596 | 8/1934 | Coberly | 74/89.22 |
| 3,345,950 | 10/1967 | Bender | 74/590 X |
| 3,483,828 | 12/1969 | Bender | 74/590 X |
| 3,737,751 | 6/1973 | Lima | 318/463 |
| 4,191,915 | 3/1980 | Johansson | 318/464 |
| 4,391,155 | 7/1983 | Bender | 417/44 X |

*Primary Examiner*—Edward K. Look

*Attorney, Agent, or Firm*—Edward L. Jensen & Assoc.

[57] ABSTRACT

A yo-yo variety reciprocating drive for long stroke, well pumping units, which employ a flexible element as the operative link between the winding drum and the polish rod of the well pump. Reversal from an upstroke to a downstroke is cushioned by mechanism which provides a power source off dwell period of predetermined duration during the aforesaid stroke exchange and is adjustable to control the length of stroke of the pumping unit. A velocity control senses the velocity of the polish rod during such dwell period and re-energizes the power source when a predetermined velocity is achieved following reversal of direction.

14 Claims, 4 Drawing Figures

Fig. 3
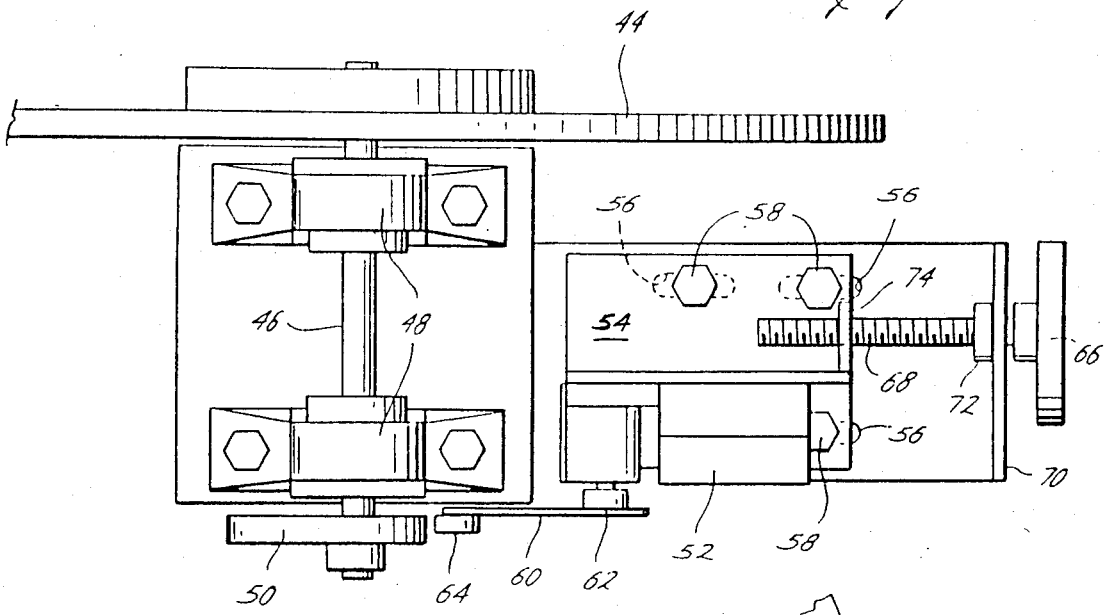
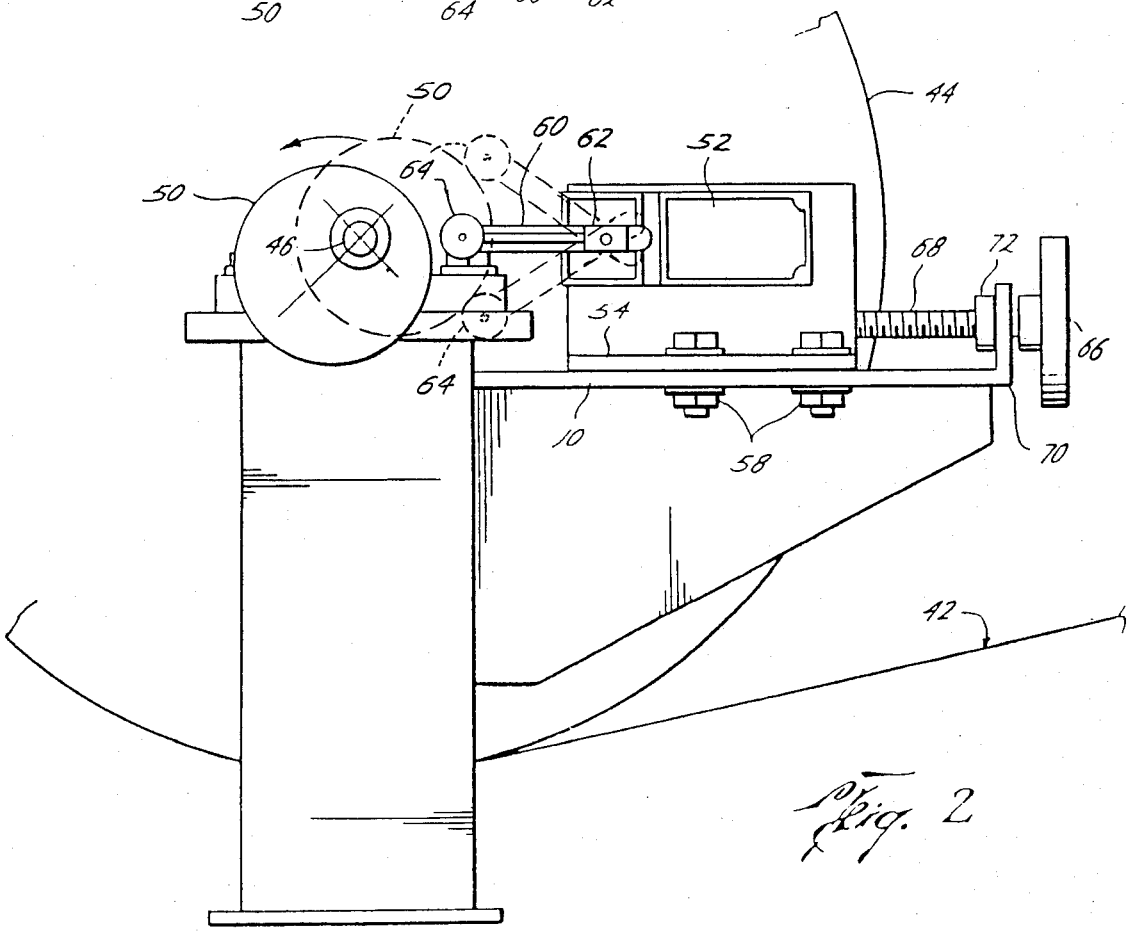
Fig. 2

RECIPROCATING DRIVE AND VELOCITY CONTROL FOR LONG STROKE WELL PUMPING UNIT

BACKGROUND OF THE INVENTION

This invention relates generally to long stroke, well pumping units and more specifically to an uncomplicated velocity control and improved drive for imparting reciprocating movement to the polish rod of the pump. The invention includes an improved and reliable reciprocating drive wherein a dwell period is provided between an upstroke and a downstroke during which the power source is in an off position, and a velocity control which senses the velocity of the polish rod during the aforementioned dwell period and energizes the power source when a predetermined velocity is achieved following reversal of direction. Generally, the predetermined velocity is selected to correspond with the normal operating speed of the system and power is applied or dissipated by the power source when the predetermined velocity is achieved to prevent under speed or over speed of the system, respectively. In this manner, the velocity control automatically adjusts the system to accommodate varying load conditions due to changes in the gas/oil/water ratios, known as "buoyancy" of the well, and friction within the system. This adaptability results in substantially increased efficiency and conservation of energy, while at the same time reducing wear and tear on the system and increasing the life of the unit.

The invention has particular utility with a long stroke, well pump employing a reversible motor as the power source. Such a well pumping unit, as herein disclosed, includes a tower mounted on a base platform, a source of power in the form of an electric or hydraulic motor, a winding drum on the base platform driven from the electric or hydraulic motor, a lift belt made of conveyor belting extending from the winding drum up the tower and over a spool mounted atop thereof and then downwardly to the polish rod of the otherwise conventional well pump. A counterweight or weight box is interposed in that portion of the lift belt between the spool and the winding drum so that power requirements are kept to a minimum. An idler spool is provided at the base of the tower and that portion of the lift belt between the counterweight and the winding drum is trained beneath the idler spool so as to eliminate any side to side movement of the counterweight during operation of the pump. Mechanism is designed and arranged to interrupt the power to the motor for a predetermined dwell period as the polish rod approaches completion of an upstroke, and to reverse the direction of the motor after the polish rod decelerates, reverses direction and travels a predetermined distance in the downstroke. The reversing mechanism is provided with an adjustment feature which allows the time of interruption and the duration of the dwell period to be adjusted, thereby allowing the length of stroke to be readily changed, without shutting down the unit. The velocity control contemplated by the invention is designed and arranged to be responsive to the velocity of the polish rod, sense the direction of rotation of the motor and energize the motor in the desired direction of rotation when the polish rod achieves a predetermined velocity. The predetermined velocity is normally set at the synchronous speed of the motor, but may be set at other speeds, if desired, depending upon the specific starting requirements. Since an induction motor's synchronous speed will vary slightly with load, we will define synchronous speed to include the entire normal operating range of the motor in a given system.

A brief description of the background and development of well pumping units is appropriate. In the early life of a well, reservoir pressure alone may be sufficient to lift the oil to the surface, providing local regulatory authorities permit such a procedure. However, such pressure is eventually exhausted whereupon the oil must be pumped to the surface. The most common variety of pump in use is a walking beam pump having a nominal stroke of approximately seven to twelve feet. A walking beam pump is suitable for shallow to medium depth wells, but such a pump becomes increasingly inefficient as well depth and stroke frequency increases. Specifically, rod stretch, dynamics and pump volumetric efficiency combine to decrease efficiency as well depth and stroke frequency increases.

Thus, long stroke well pumping units, particularly useful in deep wells, have been developed, some having stroke lengths of thirty-two feet or more. An early example of such a prior art long stroke pumping unit is the long stroke pumping mechanism disclosed and claimed in prior U.S. Pat. No. 1,970,596 issued to Clarence J. Coberly. Coberly's mechanism includes a cable system connected at one end to the polish rod and extending up and over a sheave mounted on a tower above the well, down and around a drum mounted at the base of the tower, and connected at its other end to a counterweight arrangement. The drum is driven in first one direction and then the other by a reversible motor to provide reciprocating motion to the polish rod, and a system of cams on a shaft are positively driven by rotation of the drum through appropriate gear reduction to actuate sequentially a series of spring contracts controlling the direction and magnitude of current to the motor to accelerate the motor harmonically from zero to maximum speed, maintain it and deccelerate to zero again, reverse current direction to the motor and then repeat the operation, thereby to rotate the drum in alternate directions and reciprocate the polish rod. It is noteworthy that reciprocation is achieved by motor reversal only, and that acceleration and decceleration is achieved in response to cam sequence and rotation corresponding to fixed increments of travel (distance) regardless of speed.

An improved prior art long stroke pumping unit is the wire line deep well pumping apparatus disclosed and claimed in prior U.S. Pat. No. 3,248,958 issued to Emil A. Bender. The long stroke pumping unit discussed therein is a basic yo-yo variety which has a power system in which a cycle of takeup (during pump upstroke) and payout (during pump downstroke) is accomplished without the need for winding drum reversal; thus, the power source of the unit is reversed only after a full cycle of operation rather than with each stroke, as in the case of the Coberly unit. As disclosed in the Bender Patent, a simple limit switch (responsive only to distance of travel) is disclosed for reversing the electric motor and although the Patent further suggests that polish rod stroke and time delay (which at best introduces a fixed time response) may be modulated, no structure or system is disclosed for accomplishing such results. Another prior U.S. Pat. No. 3,345,950 to Emil A. Bender discloses a long stroke, well pumping unit either electrically or hydraulically powered and including a limit switch system alternately operated by the yoke suspending the polish rod and the counterweight (fixed distance response) to effect power source reversal.

Yet another invention to Emil A. Bender, U.S. Pat. No. 4,391,155, involves a well pumping unit wherein a yo-yo drive as above discussed is employed with a flexible lift belt being the operative connection between the winding drum and the polish rod, and power source reversal is positively associated with the winding drum rather than other components of the system. In this unit, a reversing mechanism is provided including a chain and sprocket transmission operable from the winding drum and rotating a contact for a limit switch. The reversing control mechanism consists of two side by side disks configured with identical chordal edges over a significant portion of the circumference to allow manual, relative adjustment to define a V-shaped notch in the combined circumferential camming surface. The disks cooperate with a 3-position switch so that the switch is spring-biased to a neutral (power-off) position when disposed in the V-shape notch, and is cammed to a second (power on in one direction) position upon rotation of the disks in one direction and cammed to a third (power on in the opposite direction) position upon reverse rotation of the disks. Here again, a fixed distance (albeit adjustable) reversing control is taught. Furthermore, in order to adjust the reversing mechanism, the operation of the unit must be terminated and the reversing mechanism partially disassembled, and precise centering of the 3-position switch and exact adjustment of the disks to define co-equal spaces either side of the center-line of the V-shaped notch, is essential in order to establish and maintain a uniform length of stroke in either direction of rotation of the winding drum.

An improved reciprocating drive and control mechanism invented by Tam Duc Le and Weems D. Turner is the subject of a co-pending application, Ser. No. 489,826, filed Apr. 29, 1983 and assigned to the assignee of the present invention. In this example of the prior art, a reversing mechanism is responsive to rotation of a winding drum and includes a cam in the form of an eccentric disk and a 3-position switch arranged to reverse the direction of the power source when a predetermined stroke (responsive to a fixed distance) has been completed. The relative positions of the cam and the 3-position switch may be manually adjusted while the unit is operating to modify the length of stroke to the desired dimension.

Other prior art reversing or control mechanisms in similar pump applications all include a simple limit switch (fixed distance response) similar to the examples described above. Such prior art neither teaches, nor recognizes the substantial advantages of, a unique control mechanism responsive to the velocity of the system and designed to energize the power source in the proper direction when the velocity of the system reaches a predetermined operating speed.

SUMMARY OF THE INVENTION

Therefore, it is a primary object of the invention to provide a velocity control positively associated with a reciprocating drive train wherein stroke reversal is accomplished by de-energizing the power source for an adjustable dwell period and allowing the inertia of the system to accomplish stroke reversal, and wherein the velocity control is responsive to the velocity of the system and re-energizes the power source in the proper direction when the velocity of the system reaches a predetermined operating speed.

It is another primary object of this invention to provide a velocity control in a yo-yo variety, long stroke, well pumping unit wherein the power source is de-energized for an adjustable dwell period as the unit approaches completion of an upstroke of the polish rod, thereby allowing the polish rod to deccelerate, reverse direction and fall by gravity to commence a downstroke and accelerate the drive train in the reversed direction, and wherein the velocity control senses the velocity of rotation of the drive train and re-energizes the power source when a pre-determined velocity is achieved in the reversed direction and power is applied or dissipated by the power source to prevent under speed or over speed, respectively.

Yet another primary object of the invention is to provide a yo-yo variety of long stroke, well pumping unit of the type described including an adjustable velocity control which energizes the power source when a predetermined velocity is achieved thereby automatically compensating for varying load conditions due to changes in the buoyancy of the well and friction within the system, resulting in substantially increased pump efficiency and conservation of energy, while at the same time reducing wear and tear on the system and increasing the life of the unit.

It is a further object of the invention to provide a yo-yo variety, long stroke, well pumping unit employing a flexible lift belt as the operative connection from the winding drum to the polished rod wherein the winding drum is driven by an electric motor through appropriate gear reduction and a reversing mechanism de-energizes the motor for an adjustable dwell or rest period as the polish rod approaches completion of the upstroke, a velocity control adjustable to re-energize the motor in the opposite direction when the polish rod reverses direction and accelerates by gravity to a predetermined velocity corresponding to the synchronous speed of the motor, thereby to decrease starting current requirements, prolong motor life, increase contact life, reduce strain on the gear box, belts and bearings, and reduce stress on the polish rod string.

Still another object of the invention is to provide a yo-yo drive, long stroke, well pumping apparatus with a velocity control of the type described wherein the velocity control is adapted to be overridden by safety switches on the unit and by the reversing mechanism if the predetermined velocity is not achieved within a pre-set duration of dwell period.

In general, the long stroke, well pumping unit embodying this invention includes a base platform, a tower on the base platform, a drive train including a rotatable, winding tube on the base platform and a power source to rotate the drum, a flexible element attached at one end to the drum and at its other end to the polish rod of a pump, a freely rotatable spool mounted atop the tower over which the flexible element is trained and a counterweight is attached to the flexible element on the opposite side of the spool from the polish rod. A mechanism is provided for reversing the power source thus to cyclically wind and unwind the flexible element from the winding drum and thereby to impart reciprocating movement to the polish rod of the pump. The reversing mechanism includes mechanism for de-energizing the power means as the polish rod approaches a desired length of upstroke whereby the polish rod decelerates, reverses direction and accelerates again in the reverse direction or downstroke under the force of gravity. A velocity control is provided for re-energizing the power source when the polish rod reaches a predetermined velocity in the downstroke, which velocity control includes mechanism for monitoring the velocity of the polish rod and a comparator mechanism responsive to the monitoring mechanism and comparing the velocity of the polish rod with a predetermined reference level, to re-energize the power source when the velocity of the polish rod reaches the pre-determined reference level.

A preferred long stroke, well pumping unit embodying this invention includes a base platform, a tower on the platform, a rotatable winding drum on the platform with an electric motor, preferably, to impart rotation to the winding drum, a flexible lift belt connected at one end to the winding drum and at its other end to the upper end of the polish rod of a well pump, and a freely rotatable spool on top of the tower, over which the lift belt is trained. A counterweight is located on the lift belt, between the winding drum and the spool, and an idler spool is located in the base of the tower, that portion of the lift belt between the counterweight and the winding drum being trained beneath the idler spool. The idler spool and upper spool arrangement generally confine counterweight movement during pumping operation to a vertical direction. A reversing mechanism is provided including, for example, a chain and sprocket transmission operable from the winding drum and rotating a position cam for engaging a cam follower arm of a limit switch. The position cam may, for example, take the form of a generally circular disk asymmetrically mounted on an axle or shaft driven by the chain and sprocket transmission, and the cam follower arm may be the position or actuator arm of a 3-position limit switch adjustably mounted on a base in the plane of the circular disk and moveable toward and away therefrom. The position arm of the 3-position switch is spring biased to a neutral (contacts open) position in alignment and perpendicular to the axis of rotation of the circular disk and includes a roller in following engagement with the circular disk so that the arm is pivoted upon rotation of the disk to one of two operative (contacts closed) positions, depending upon the direction of rotation of the disk. The structure and arrangement of the control or reversing mechanism greatly reduce and cushion the shock of exchange from an upstroke to a downstroke and allows manual adjustment of the length of stroke during operation of the pump by controlling the point in the upstroke at which time the power source is turned off and the length of time (dwell period) the power source remains off, thus allowing the polish rod to decelerate and gently fall under the force of gravity upon the rod string load, which is somewhat greater than that of the counterweight, before the power source is turned on again by the reversing mechanism in the opposite direction.

The preferred velocity control contemplated by the present invention includes a tachometer positively associated with the winding drum for sensing the speed and direction of rotation of the drum and furnishing a measurable output signal corresponding to such speed and rotation, and a comparator circuit for comparing the output signal from the tachometer with a predetermined reference signal selected to correspond to the synchronous speed of the motor in the desired direction of rotation, and said comparator being arranged in circuit with the motor to energize the motor and hold the motor in an energized state when the tachometer output signal matches the reference signal, until the reversing mechanism overrides the velocity control upon completion of the aforesaid dwell period.

In a more specific embodiment of the velocity control, a pair of comparator circuits are arranged to receive the output signal of the tachometer, a first comparator being responsive to a negative output signal indicative of counterclockwise rotation of the drum and energizing the motor to drive the winding drum in said counterclockwise direction when the output signal matches the reference signal, and the second comparator being responsive to a positive signal indicative of rotation of the drum in the clockwise direction and energizing the motor to drive the winding drum in said clockwise direction when the output signal matches that reference signal. A further refinement includes a feedback circuit arranged in circuit with each comparator to utilize the energizing output of the comparator to bias the reference signal of the comparator to a smaller absolute value once the comparator is triggered, thereby to lock up the comparator in an energizing condition and prevent chatter of starter contacts for the motor or de-energizing of the motor if the velocity of the polish rod should for any reason fall below the pre-determined level. A secondary biasing circuit is also provided, responsive to the tachometer and imposing a time delay, for biasing the reference signal of the actuated comparator to an abnormally high absolute value, said time delay being sufficient to allow the first or second comparator, depending upon the direction of rotation, to energize the motor and the reversing mechanism to be actuated to maintain the energized state of the motor, thereby to prevent re-actuation of that comparator until after stroke reversal again.

Further novel features and other objects of this invention will become apparent from the following detailed description, discussion and the appended claims taken in conjunction with the accompanying drawings.

BRIEF DESCRIPTION OF THE DRAWINGS

A preferred structural embodiment of this invention is disclosed in the accompanying drawings in which:

FIG. 2 is a fragmentary view taken along line 2—2 of FIG. 1 depicting a reversing mechanism with override control for power source reversal of the pumping unit, and illustrating in phantom lines the two operative positions of a circular disk and position arm of the limit switch during a full cycle of pump operation;

FIG. 3 is a top plan view of the reversal mechanism shown in FIG. 2.

DESCRIPTION OF THE PREFERRED EMBODIMENT

Figure 1:
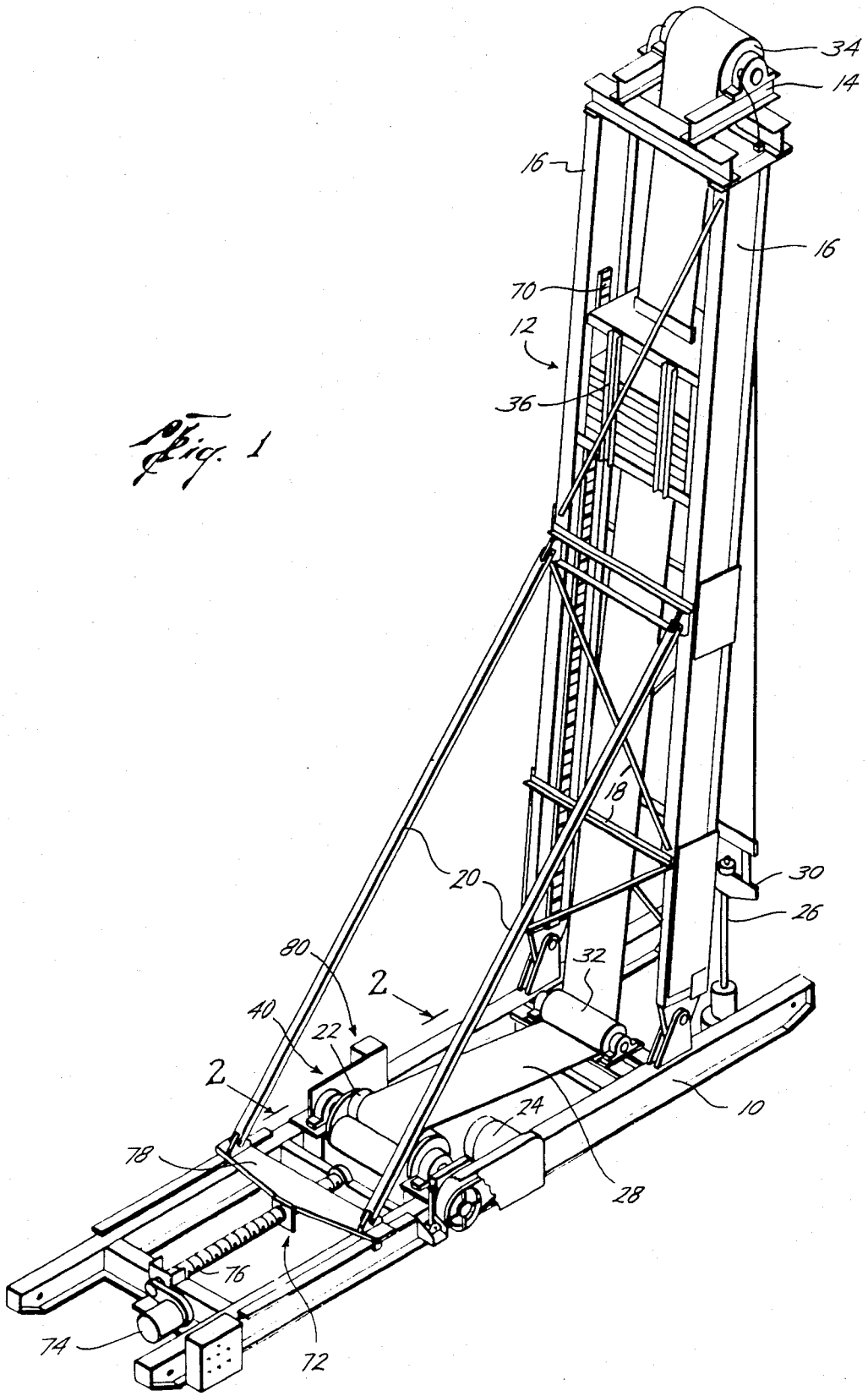
FIG. 1 is an isometric elevation view of a well pumping unit embodying this invention.

Referring now to the drawings by reference character, and in particular in FIG. 1 thereof, an improved long stroke, well pumping unit is illustrated. A skid mounted base platform 10 supports a tower structure or mast 12 and a top platform 14 surmounts the mast 12. The mast 12 is composed of two parallel I-beams 16—16, pivotally mounted to the base platform 10 and structurally stabilized intermediate their lengths by a series of cross members and struts 18—18, the beams 16—16 being further stabilized vertically with respect to the base platform 10 by two parallel mast supports 20—20. A rotatable winding drum 22 is located on base platform 10 and is driven by a belt drive arrangement from a power source 24. An otherwise conventional well pump (not shown) includes a rod string and sucker rod therein, topped by a conventional polish rod 26. A flexible lift belt 28 is secured at one end to rotatable winding drum 22 and at its other end to a yoke assembly 30 from which the polish rod 26 is centrally suspended. Flexible lift belt 28 is reaved beneath an idler spool 32 on base platform 10, then upwardly through mast 12, to and over a crown spool 34, freely rotatably mounted atop the top platform 14, and then vertically downwardly to yoke assembly 30. A counterweight or weight box 36 is interposed in the lift belt 28 between the idler spool 32 and the crown spool 34 and reciprocates generally vertically with movement of lift belt 28 between the upper and lower ends of the mast 12.

By way of example, the power source 24 selected for this preferred embodiment is a reversible electric motor identified as a "Baldor Industrial Electric Motor: with the following specifications: 50 Horse Power, 460 Volts, 3 Phase, 60 Hertz, Class F Insulation, 1760 Revolutions Per Minute, NEMA B, Code G. Commercially available conveyor belting may be employed as the material for life belt 28. One available brand of conveyor belting that might be used is that sold under the trademark "UNILOK" as "PolyVinylok" conveyor belting. One particular material found to be useful is Unilok's PVK-350 Material, a belting that is 5/16 inches thick, 15 inches wide and has an ultimate tensile strength at rupture of 3500 pounds per inch. Similar materials sold under this same mark are available, up to 15/32 inches thick and having an ultimate tensile strength at rupture of up to 9000 pounds per inch. Belt widths may vary from 15 inches to 30 inches or more. The particular belting material chosen will, of course, depend on the design requirements of the particular well pumping unit.

A reversing mechanism is generally indicated by reference numeral 40 in FIG. 1, and the components and arrangement thereof can be viewed in detail by reference to FIGS. 2 and 3. The specific reversing mechanism selected in this preferred embodiment is the subject of a co-pending application by Tam Duc Le and Weems D. Turner, Ser. No. 489,826, filed Apr. 29, 1983; however, other reversing mechanism such as that disclosed in the aforementioned U.S. Pat. No. 4,391,155, to Emil A. Bender or other prior art reversing devices would also be suitable. A sprocket and chain transmission indicated generally by the numeral 42 is operable from winding drum 22 to drive a timing sprocket 44 secured at one end of a shaft 46 rotatably mounted in bearings 48—48 on the base platform 10. A cam or disk 50, generally circular in configuration, is secured asymmetrically at the other end of shaft 46, and the timing sprocket 44 is sized so as to rotate the disk 50 through slightly less than one full revolution (say 270 to 300 degrees, for example) for each complete cycle of the pumping unit including one downstroke and one upstroke at the maximim design stroke length selected for the unit. A three position limit switch 52 is secured to a carriage or plate 54 which is slidably mounted on base platform 10 for guided movement toward and away from the disk 50 as permitted by slots 56—56 in the plate 54 receiving fasteners 58—58.

The limit switch 52 may be of any conventional, commercially available type, such as Cutler Hammer E50 SN Limit Switch, and is suitably and conventionally connected to power source 24. This particular limit switch includes a position or actuator arm 60 pivotably mounted at one end 62 to the body of the switch and provided at its other end with a freely rotatably roller 64 for following engagement with the disk 50. The actuator arm 60 is conventionally spring-biased (not shown) to a neutral position extending out perpendicularly from one end of the switch body, and may be cammed or pivoted to either side of the neutral position to one of two actuated positions shown in phantom lines in FIG. 2. The limit switch 52 is arranged relative to the disk 50 and shaft 46 so that actuator arm 60 is in the plane of disk 50 and perpendicular to the axis of shaft 46 when the arm is in the neutral position. An adjustment knob 66 is provided with a shaft 68 rotatably mounted at one end adjacent the knob 66 in bracket 70 secured to base platform 10 and constrained against axial movement by a shoulder or stop 72 on the shaft. The other end of shaft 68 is threaded and engaged with a like threaded connector 74 secured to plate 54. Thus, the position of the limit switch 52 may be adjusted to move the actuator arm 60 toward and away from the disk 50 within the plane of the disk and radially of the axis of rotation thereof, by turning the knob 66 in a counterclockwise or clockwise direction, respectively, with a standard right handed thread on the shaft 68.

In a commercial embodiment, a safety mechanism (not necessary to the understanding and utility of the invention and therefore not shown) is mounted on the underside of the weight box 36 and, in the event of failure by fracture of any portion of the lift belt 28, polish rod 26 or one of the components of the rod string, is operable to immediately engage a safety latch located on either side of the weight box 36 with the teeth of a corresponding rack 70 mounted on the inside web of each beam 16 and thus prevent counterweight 36 from falling. In this arrangement, the vertical movement of the weight box 36 is stabilized within the mast 12 by a series of front and back guide rollers (not shown) that roll on inside flanges of each beam 16 and further by a series of side wheels (not shown) that ride on the interior web of each beam 16. The location and arrangement of the guide rollers and side wheels is designed to facilitate and confine movement of the weight box 36 in and to a generally vertical direction within the mast 12. Thus, side to side movement of weight box 36 during operation of the pump, which motion induces unnecessary lateral strains on the entire unit, is effectively eliminated. This particular fail safe mechanism is the subject of a co-pending application by Tam Duc Le and Weems D. Turner, Ser. No. 489,728, filed Apr. 29, 1983, to which reference may be made for a detailed description; however, other conventional safety or fail safe mechanism may be employed to arrest free fall of the weight box 36 in the event of failure of the lift belt 28, polish rod 36 or one of the components of the rod string as discussed above.

With particular reference now to FIG. 2, the yo-yo operation and stroke reversal of the unit will now be described as the setting in which the velocity control of the invention may be best appreciated and described. For convenience of discussion, a cycle begins with weight box 36 in its lowermost position, yoke 30 and polish rod 26 in their uppermost position and flexible belt 28 being wound as fully as it ever will be upon drum 22. From this initial position and as described herein, a downstroke is about to begin. At this stage in the cycle, the reversing mechanism 40 is positioned as illustrated in FIG. 2 with disk 50 being driven in a counter-clockwise direction and oriented on shaft 46 so as to be just past the top dead center position of smallest effective radius in the direction of rotation. Actuator arm 60 of limit switch 52 is shown out of contact with disk 50 and spring-biased to the neutral position; thus, the electric motor comprising the power source 24 is in a power off position. Weight box 36 has previously been weighted so that polish rod load exceeds the load generated by the counterweight. Thus, the polish rod load causes yoke 30 and polish rod 26 to descend, initiating a downstroke and winding drum 22 is forced to rotate in a counterclockwise direction, in the sense of FIG. 2, as flexible belt 28 is paid out therefrom. Simultaneously, disk 50 of control mechanism 40 is caused to rotate counterclockwise because of the chain and sprocket transmission connection to winding drum 22. The roller 64 is engaged by and rides on the top of disk 50 causing actuator arm 60 to move up to a first actuated condition (the uppermost position shown in phantom lines in FIG. 2) in which the limit switch 52 turns the power source motor on in a counterclockwise direction. Switch 52 is maintained in this first on position as the downstroke continues and disk 50 continues its counterclockwise rotation, with roller 64 riding about the periphery of disk 50.

It is important to note that as the downstroke continues and with power source motor 24 turned on, as just described, the winding drum 22 drives the motor and thus a counter electromotive force is generated in the power source motor 24 which may be used to salvage much of the kinetic energy in the moving parts of the system; in short, the motor acts as a generator as the downstroke continues, in a manner well known in the electrical art.

As the downstroke nears an end, disk 50 will have rotated about 140 degrees from the initial position shown in FIG. 2A. At this point, all of the flexible belt 28 will have been unwound from drum 22 but the drum will continue to rotate in a counterclockwise direction thus initiating an upstroke as flexible belt 28 is rewound upon drum 22 in yo-yo fashion. Since the limit switch 52 remains in the uppermost position illustrated in phantom lines in FIG. 2, the power source motor 24 then runs under load and the weight box 36 travels from the position at the top of the mast 12 to the bottom of the mast. Thus, a full cycle of a downstroke and an upstroke is accomplished without the need for reversal of rotation of winding drum 22 or motor 24.

As the upstroke nears completion, the disk 50 will have rotated in a counterclockwise direction to the point where its eccentric orientation to shaft 46 reduces the effective radius of the disk as a cam and allows actuator arm 60 to fall off and be spring-biased to the neutral position again out of contact therewith, whereupon limit switch 52 returns the power source motor 24 to a power off position. The momentum of the system causes the polish rod 26 to continue to rise a short distance against the force of gravity on the polish rod and rod string, but decelerates and then begins to fall again, commencing the downstroke of a new cycle, because of the load differential between the weight box 36 and the polish rod and rod string. At the completion of the upstroke, the eccentric disk 50 will have rotated about 280 degrees to a point of minimum effective radius as a cam, and as the polish rod 26 begins to descend again, the winding drum 22 is now forced to rotate in a clockwise direction, in the sense of FIG. 2, as flexible belt 28 is paid out therefrom. This of course, causes disk 50 of the control mechanism 40 to rotate in a clockwise direction and assume the position shown in solid lines in FIG. 2 with actuator arm 60 again in the neutral position, as described. As the downstroke continues, the effective radius of disk 50 increases and cams the actuator arm 60 downwardly with roller 64 now riding on the underside of the disk to a second actuated condition (the lowermost position shown in phantom lines in FIG. 2) in which limit switch 52 turns on the power source motor 24 in a clockwise direction. Additionally, the motor again acts as a generator, as described above. When the second downstroke has been completed, the drum 22 again continues to rotate in the same direction (clockwise) thus rewinding flexible belt 28 thereon without reversal of the direction of rotation of winding drum 22 and with power source motor 24 under load to effect a second upstroke. At the termination of the upstroke and commencement of a third downstroke, the reversing mechanism again assumes the attitude illustrated in solid lines in FIG. 2 and the first of the two cycles just described is repeated. Thus, only one drum and motor reversal is required for every two strokes or one cycle of pump operation. From the foregoing description, it will be appreciated that the length of stroke of the unit is determined by length of time the power source motor 24 remains in a power on condition during the upstroke of polish rod 26, and when power is interrupted, the polish rod thereafter decelerates under the polish rod load to top dead center before beginning to descend again initiating a new downstroke. Stated conversely, the dwell period or amount of time actuator arm 60 of the limit switch 52 remains in the neutral position with the motor 24 in a power off position, during which time the polish rod 26 decelerates and begins to fall again, determines stroke length. In either case, the point in time at which the power to the power source motor 24 is interrupted during the upstroke of any cycle, controls the length of stroke, and is determined by the point in rotation of disk 50 at which its effective camming radius reduces sufficiently to allow actuator arm 60 to return to the neutral position. The effective camming radius of the disk 50 in turn is a function of the amount of eccentricity in its orientation on shaft 46, and the distance between the axis of rotation of disk 50 and roller 64 on the actuator arm 60 in the neutral position, which is adjustable. The orientation of the disk 50 on shaft 46 must be such that at top dead center of each cycle, the smallest effective camming radius is exposed to the roller 64 to insure that the length of stroke will be uniform regardless of the direction or rotation of winding drum 22 and hence the disk 50.

The length of stroke may be adjusted by turning adjustment knob 66 counterclockwise to advance limit switch 52 toward disk 50 in order to lengthen the stroke, or clockwise to draw the limit switch away from the disk in order to shorten the stroke. As described, such adjustment amounts to a simple manipulation by hand and may be accomplished without the necessity of shutting down the pumping unit and losing valuable production time.

In this specific embodiment of the invention, a tilt mechanism is provided, indicated generally by the numeral 72 in FIG. 1, for adjusting the attitude of the mast 12. Such a mechanism may include a drive motor 74, screw 76 and carriage 78 which cooperate to tilt the mast forward and back through mast supports 20—20. This tilt mechanism, though not essential to the present invention, is described in detail and claimed in a copending Application Ser. No. 489,821, filed by Tam Duc Le and Weems D. Turner as inventors on Apr. 29, 1983. As a further point of interest, pumping unit is dimensioned to provide a 25 foot stroke of polish rod 20. This is economically practical because commonly available, off-the-shelf components may be interfaced with the unit. For example, standard polish rods and standard rods making up the rod string are compatible with a pump having a 25 foot stroke.

In a long stroke well pumping unit such as that described above, it has been discovered that effective velocity control is critical and an optimum velocity must be established and maintained at the earliest possible instant following start-up and reversal of direction in order to avoid under speed or over speed in the payout of the lift belt. An adjustable velocity control contemplated by the present invention further allows compensation for variable load conditions due to changing gas/oil/water ratios or buoyancy of the well. Such a control system increases efficiency; reduces stress on the rod string, gear box, belts and bearings; prolongs the life of the motor, contacts and pump; and decreases the starting current to the motor. Overall, the unit is less sensitive to variations in well bore conditions. The preferred velocity control also permits separate adjustment for each direction of rotation of the motor in order to compensate for associated variances in the unit itself, such as imbalance in the yo-yo system due to asymetric angle of wrap of belt on the winding drum or differences in friction or loads in the respective directions of travel.

Figure 4:
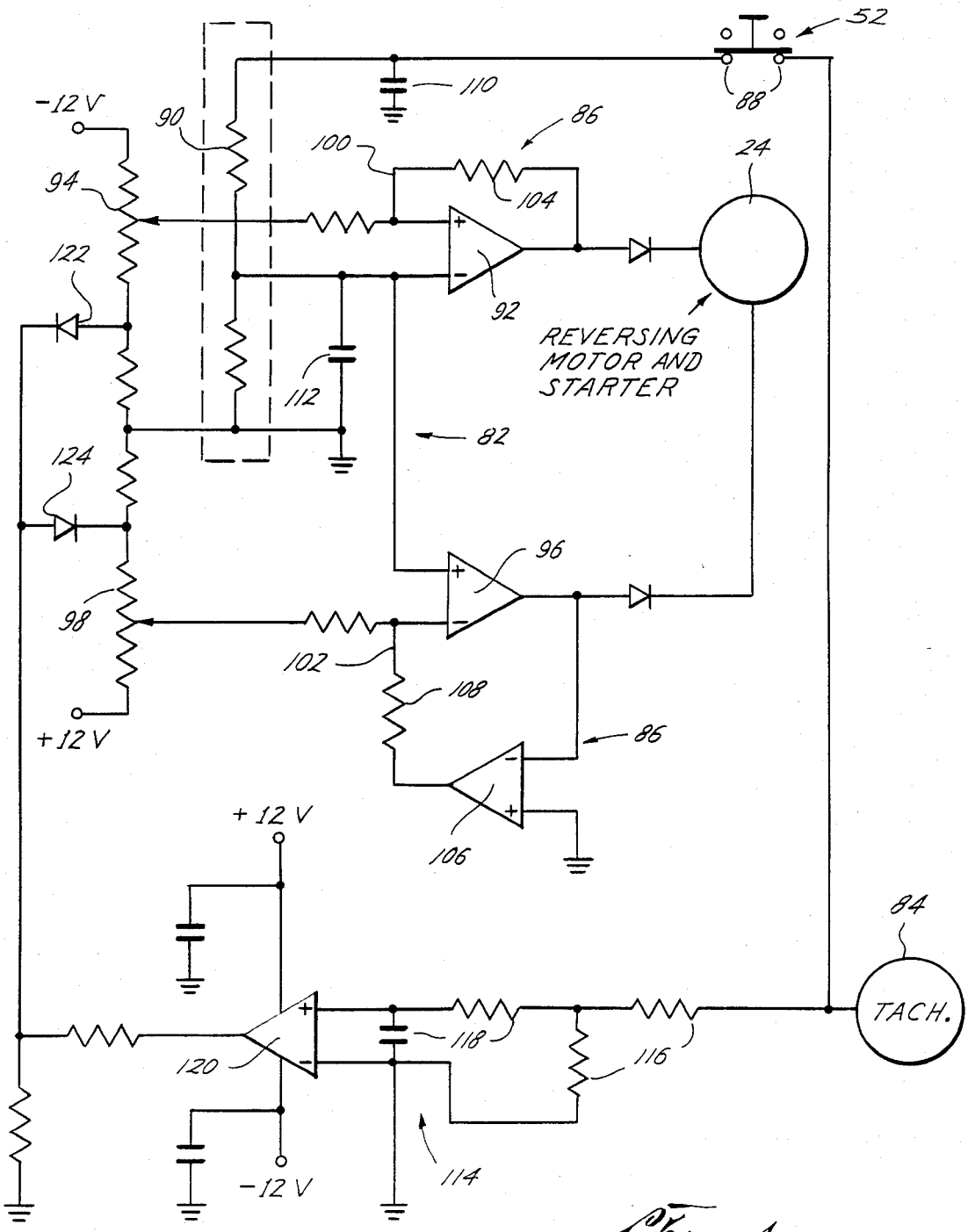
FIG. 4 is a schematic diagram of a velocity control for energizing the power source at a predetermined velocity in the reverse direction following completion of an upstroke by the polish rod.

Basically, the velocity control of the invention, indicated generally at 80 in FIG. 1, is responsive to the velocity of the unit in either direction and adjustable to energize the motor 24 at the selected synchronous velocity and compensate for variations in the well bore conditions. The velocity control 80 consists of an electrical control circuit for the motor 24 shown schematically in FIG. 4, and includes an RPM controller 82 responsive to the output signal of a tachometer 84 arranged in a manner well known in the art to monitor the speed and direction of rotation of the winding drum 22, and adjusted to actuate a conventional starter within the motor and energize the motor when the tachometer signal matches a reference signal corresponding to the selected synchronous speed of the motor. The velocity control 80 is further responsive to the position limit switch 52 of the reversing mechanism 40 so as to be operative only when the motor 24 is de-energized, i.e. during the dwell period at the completion of a cycle of the polish rod 26, and is overridden when the position switch 52 becomes operative to energize the motor in the reversed direction of travel. The velocity control 80 is also overridden by and subordinate to all safety limit switches and overload protection devices that may be provided for the unit.

The preferred embodiment of the velocity control further includes a hysteresis feed back circuit 86 in the RPM controller 82 for each direction of rotation, biasing the reference signal representative of velocity in a respective direction to a slightly reduced absolute level once the predetermined velocity is reached, to avoid chatter of the motor starter contacts and retain the motor in an energized state until the reversing mechanism 40 overrides the velocity control to maintain the energized condition of the motor at synchronous speed. Also, a different reference signal may be established for each direction of rotation to accommodate variations in the corresponding operating loads.

In the operation of the pumping unit, the polish rod is moved through a complete cycle with the motor 24 driving the winding drum 22 in a first direction effecting a downstroke and upstroke through the yo-yo action payout and takeup of the lift belt 28. The reversing mechanism 40 senses the approaching completion of the upstroke and the 3-position limit switch 52 returns to a neutral position to interrupt power to the motor 24 and commence the dwell period, after which the switch is advanced to the third position energizing the motor 24 in the reverse direction. The velocity control 80 is activated by return of the 3-position limit switch to the neutral position, at which time the RPM controller 82 becomes responsive to the output signal of the tachometer 84 monitoring the rotation of the winding drum 22. As the motor 24 is de-energized, the polish rod load decelerates due to gravitational force and reverses direction of travel causing payout of the lift belt 28 from the winding drum 22. The RPM controller 82 senses the velocity of the winding drum 22 in the reverse direction through the tachometer 84, comparing the tachometer output signal to the reference signal, and actuates the starter to energize the motor in the reversed direction when the polish rod load has accelerated the rotation of the winding drum to the predetermined velocity corresponding to the selected synchronous speed of the motor. In this embodiment, the output of the tachometer 84 is a voltage signal input to the RPM controller 82 and compared with a reference voltage signal corresponding to the selected velocity. When the tachometer voltage output equals the threshold voltage of the reference signal, the RPM controller 82 actuates the motor starter to energize the motor 24, and simultaneously the hysteresis circuit 86 biases the threshold voltage to a slightly reduced absolute value to avoid starter chatter and retain the energized state of the motor. By way of example, and assuming a threshold voltage level of say 5 volts, when the tachometer output is 4 volts, no actuating output from the RPM controller 82 is sent to the motor starter. When the tachometer output reaches 5 volts, the motor starter is actuated and the hysteresis circuit biases the threshold voltage to a reduced level of say 4 volts, and the RPM controller 82 is locked up in the actuating condition. As rotation of the winding drum 22 causes the reversing mechanism 40 to trip the 3-position switch 52, the motor 24 is independently energized and the velocity controller 80 overridden with the synchronous velocity of the motor already established. The threshold voltage of the reference signal is then biased upward, to say 10 volts, to prevent accidental actuation of the velocity controller 80 until the next cycle is complete. In the next cycle, the process is repeated, but again in a reverse direction.

The following represents a detailed description of the circuit arrangement representing a preferred embodiment of the velocity controller 80. The output of the tachometer 84 is received when the 3-position switch 52 is in the neutral position, closing contacts 88 in a conventional manner. The tachometer 84 may be one of many commercially available designed to furnish an output in the form of a voltage signal. The specific tachometer selected for this preferred embodiment is a Standco Model No. BH-1-100 with a voltage output of 100 Volts D.C. per 1000 RPM with a maximum speed range of up to 6500 RPM and a maximum load of 40 Milliamps D.C. An output signal from the tachometer 84 of say 55 volts is reduced to about 5 volts by a voltage divider 90 and fed to a gate circuit or comparator 92 for comparison with a reference voltage signal corresponding to the synchronous speed of the motor 24 set by adjustment of a potentiometer 94. Actually two comparators and two potentiometers are arranged in parallel circuit relationship, one comparator 92, being responsive to a negative voltage signal set by the first potentiometer 94 between 0 and −12 volts corresponding to the desired velocity of counterclockwise rotation of the drive motor 24 to serve as a reference signal to the first comparator 92, and a second comparator 96 responsive to a positive voltage signal set by a second potentiometer 98 and between 0 and +12 volts corresponding to the desired voltage of clockwise rotation of the drive motor 24 to serve as the reference signal to the second comparator 96. The parallel circuits allow indepedent adjustment and control of velocity in both a counterclockwise and clockwise direction by adjustment of the appropriate potentiometer 94 or 98 to the desired level of reference signal.

Each comparator 92 or 96 is equipped with a feedback circuit 100 and 102, respectively, to introduce hysterysis, biasing the predetermined reference signal to a lower absolute value by reducing the high voltage signal output of the comparator through a resistor 104 in the case of the negative reference signal fed to comparator 92 (counterclockwise) direction, or through a signal inverter 106 aand resistor 108 combination in the case of the positive reference signal fed to comparator 96 (clockwise direction.) Capacitor 110 is interjected in the input circuit to hold the signal during the dwell time that mechanical switching (breaking and making of contacts) takes place in the 3-position switch 52 from neutral to the new direction and capacitor 112 further stabilizes both counterclockwise and clockwise input circuits to the corresponding comparator 92 or 96, respectively.

A direction reversal sensor 114 is in direct circuit relationship with the tachometer 84 and the tachometer output signal is reduced by a voltage divider 116. A simple Resistor-Capacitor circuit 118 is provided to introduce a time delay of about 5 to 10 seconds, before energizing a comparator 120 to produce a bias signal of 10 volts, positive if the tachometer output is positive corresponding to a clockwise direction of rotation, and negative if the tachometer output is negative corresponding to a counterclockwise directiion of rotation. The output signal is fed to bias the reference signal of the corresponding potentiometer 94 or 98 more heavily negative or positive, respectively, say to −10 volts or +10 volts. Diodes 122 and 124 control the output signal of comparator 120 so that a negative signal is fed to potentiometer 94 through diode 122 to bias the reference signal to say −10 volts, and a positive signal is fed to potentiometer 98 through diode 124 to bias the reference signal to say +10 volts. Because the tachometer output is received continuously by the direction reversal sensor 114, the bias signal and polarity will be constant throughout a complete cycle of the pumping unit (downstroke and upstroke of the polish rod), and when the 3-position switch 52 is tripped to a neutral position at the desired height of upstroke, the RC delay circuit 118 continues to hold the biasing circuit at the same polarity and level for the 5 to 10 second delay, during which time the motor 24 has been de-energized and gravity forces deceleration of the polish rod train, reversal of direction, and commencement of the down stroke. The tachometer output correspondingly diminishes in strength, reverses polarity and increases in strength again and the RC delay circuit 118 converts the gradual transition of tachometer output to a step transition after the built-in delay time has elapsed. The result is that the bias of first polarity continues throughout the cycle and for the delay or dwell time, forcing the reference signal in that direction to an artificially high level to prevent reactivation of the velocity controller 80 in that direction, so that velocity controller is responsive then only to an input signal of opposite polarity corresponding to the reversed direction.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. A long stroke, well pumping unit comprising: a base platform; a tower on the base platform; drive train means including a rotatable, winding drum means on the base platform and power means to rotate the drum means; a flexible element attached at one end to the drum means and at its other end to the polish rod of a pump; freely rotatable means mounted atop the tower, the flexible element being trained over the rotatable means; a counterweight attached to the flexible element on the opposite side of the rotatable means from the polish rod; means for reversing the power means thus to cyclically wind and unwind the flexible element from the winding drum means and thereby to impart reciprocating movement to the polish rod of the pump, said reversing means including means for de-energizing the power means as the polish rod approaches a desired length of upstroke whereby the polish rod decelerates, reverses direction and accelerates again in the reverse direction or downstroke under the force of gravity; and velocity control means for re-energizing the power means when the polish rod reaches a predetermined velocity in the downstroke, said velocity control means including means for monitoring the velocity of the polish rod, and comparator means responsive to the monitoring means and comparing the velocity of the polish rod with a predetermined reference level, to re-energize the power means when the velocity of the polish rod reaches the pre-determined reference level.

2. In a long stroke, well pumping unit including a base platform, a tower mounted on the base platform, drive train means including a rotatable, winding drum means on the base platform and power means to rotate the drum means, a flexible element attached at one end to the drum means and at its other end to the polish rod of a pump, freely rotatable means mounted atop the tower, the flexible element being trained over the rotatable means, a counterweight attached to the flexible element on the opposite side of the rotatable means from the polish rod, means for reversing the power means thus to cyclically wind and unwind the flexible element from the winding drum means and thereby to impart reciprocating movement to the polish rod of the pump, said reversing means including means for de-energizing the power means as the polish rod approaches a desired length of upstroke whereby the polish rod decelerates, reverses direction and accelerates again in the reverse direction or downstroke under the force of gravity; velocity control means for de-energizing the power means when the polish rod reaches a predetermined velocity in the downstroke, said velocity control means including means for monitoring the velocity of the polish rod, and comparator means responsive to the monitoring means and comparing the velocity of the plish rod with a predetermined reference level, to re-energize the power means when the velocity of the polish rod reaches the predetermined reference level.

3. The velocity control means as claimed in claims 1 or 2, wherein the monitoring means comprise means for producing an electrical signal which varies proportionately with the speed of rotation of the drum means.

4. The velocity control means as claimed in claim 3, wherein the comparator means comprise an electrical comparator circuit responsive to said monitoring means and including a comparator and means for producing an electrical reference signal corresponding to a predetermined speed of rotation of the drum means, said comparator also being responsive to said reference signal and producing an output signal which re-energizes the power means when the signal indicative of the speed of rotation of the drum means matches the reference signal.

5. The velocity control means as claimed in claim 4, wherein feed back circuit means are provided, responsive to the output signal of the comparator for biasing the reference signal to a lesser absolute value once the comparator is triggered, thereby to hold the comparator in an actuated condition thus re-energizing the power means for a predetermined period of time to insure normal operation of the pumping unit is resumed in the downstroke once the predetermined velocity is achieved.

6. The velocity control as claimed in claim 5, wherein secondary biasing circuit means are provided, responsive to said monitoring means, and including time delay circuit means for delaying response for a predetermined period of time during which the comparator means is responsive to the monitoring means and reference signal means to re-energize the power means, and means responsive to the time delay circuit means after the time delay to bias the reference signal input to the comparator to an abnormally high absolute value and hold it at that level during the continuation of the downstroke and a new upstroke of the pumping unit to prevent actuation of the comparator during continued rotation of the drum means in the same direction of rotation.

7. A long stroke, well pumping unit comprising: a base platform; a tower mounted on the base platform; drive train means including a rotatable, winding drum means on the base platform and power means to rotate the drum means; a flexible lift belt attached at one end to the drum means and at its other end to the polish rod of a pump; a freely rotatable spool mounted atop the tower, the lift belt being trained over the spool; a counterweight attached to that portion of the lift belt between the spool and the rotatable drum means; means for reversing the power means, thus to cyclically wind and unwind the belt from the rotatable drum means thereby to impart reciprocating motion to the polish rod of the pump and being adjustable to control the length of stroke, said reversing means including rotary motion transmission means responsive to the drive train means, a three position electrical limit switch, and means responsive to said transmission means to actuate said limit switch to one of two operative positions, a first position in which the power means is energized to rotate the winding drum means in a counterclockwise direction and a second position in which the power means is energized to rotate the winding drum means in a clockwise direction, the third position being a neutral or power off position in which the limit switch is in an unactuated condition, and said actuated means being adjustable to return the limit switch to the unactuated third position for a predetermined dwell or rest period between reversals of the power means when a desired length of stroke is completed, thereby normally to de-energize the power means for the duration of the dwell period, and to maintain the limit switch in one of the first or second operative positions at all other times; and velocity control means operative during the predetermined dwell period for re-energizing the power means when the polish rod reaches a predetermined velocity in the downstroke of the pumping unit, said velocity control means including means for monitoring the velocity of the polish rod, and comparator means responsive to the monitoring means and comparing the velocity of the polish rod with a predetermined reference level to re-energize the power means when the velocity of the polish rod reaches the predetermined reference level.

8. In a long stroke, well pumping unit including a base platform, a tower on the base platform, drive train means including a rotatable, winding drum means on the base platform and power means to rotate the drum means, a flexible lift belt attached at one end to the drum means and at its other end to the polish rod of a pump, a freely rotatable spool mounted atop the tower, the lift belt being trained over the spool, a counterweight attached to that portion of the lift belt between the spool and the rotatable drum means, means for reversing the power means, thus to cyclically wind and unwind the belt from the rotatable drum means thereby to impart reciprocating motion of the polish rod of the pump and being adjustable to control the length of stroke, said reversing means including rotary motion transmission means responsive to the drive train means, a three position electrical limit switch, and means responsive to said transmission means to actuate said limit switch to one of two operative positions, a first position in which the power means is energized to rotate the winding drum means in a counterclockwise direction and a second position in which the power means is energized to rotate the winding drum means in a clockwise direction, the third position being a neutral or power off position in which the limit switch is in an unactuated condition, and said actuating means being adjustable to return the limit switch to the unactuated third position for a predetermined dwell or rest period between reversals of the power means when a desired length of stroke is completed, thereby normally to de-energize the power means for the duration of the dwell period, and to maintain the limit switch in one of the first or second operative positions at all other times; and velocity control means operative during the predetermined dwell period for re-energizing the power means when the polish rod reaches a predetermined velocity in the downstroke of the pumping unit, said velocity control means including means for monitoring the velocity of the polish rod, and comparator means responsive to monitoring means and comparing the velocity of the rod with a predetermined reference level, to re-energize the power means when the velocity of the polish rod reaches the predetermined reference level.

9. The velocity control means as claimed in claims 7 or 8, wherein the monitoring means comprise means for producing an electrical signal which varies proportionately with the speed and is indicative of the direction of rotation of the drum means.

10. The velocity control means as claimed in claim 9, wherein the comparator means comprise an electrical comparator circuit responsive to said monitoring means and including a comparator and means for producing an electrical reference signal corresponding to a predetermined speed and direction of rotation of the drum means, said comparator also being responsive to said reference signal and producing an output signal which re-energizes the power means in the corresponding direction when the signal indicative of the speed of rotation of the drum means matches the reference signal.

11. The velocity control means as claimed in claim 9, wherein the comparator means comprise an electrical comparator circuit responsive to said monitoring means and including a first comparator responsive to the electrical signal of said monitoring means corresponding to a counterclockwise direction of rotation of the drum means, first means for producing an electrical reference signal corresponding to a predetermined speed of rotation of the drum means in the counterclockwise direction, a second comparator responsive to the electrical signal of said monitoring means corresponding to a clockwise direction of rotation of the drum means, and second means for producing an electrical reference signal corresponding to a predetermined speed of rotation of the drum means in the clockwise direction, said first comparator being actuated to re-energize the power means to drive the drum means in a counterclockwise direction when the signal from the monitoring means matches the first reference signal, and said second comparator being actuated to re-energize the power means to drive the drum means in a clockwise direction when the signal from the monitoring means matches the second reference signal.

12. The velocity control means as described in claim 11, wherein first feed back circuit means are provided, responsive to the output signal of the first comparator, for biasing the first reference signal to a lesser absolute value once the first comparator is actuated, and second feed back circuit means are provided, responsive to the output signal of the second comparator, for biasing the second reference signal to a lesser absolute value once the second comparator is actuated, whereby each of said first and second comparators, once actuated, is held in an actuated or energizing condition for a predetermined period of time sufficient to allow the limit switch of the reversing mechanism to be actuated to the first or second position, respectively, thereby to insure normal operation of the pumping unit is resumed in the downstroke of the polish rod.

13. The velocity control means as described in claim 12, wherein secondary biasing circuit means are provided, responsive to said monitoring means and including time delay circuit means for delaying response following reversal of the direction of rotation of said drum means for a predetermined period of time sufficient to allow said first or second comparator to be actuated and re-energized said power means in the corresponding direction of rotation, and means responsive to the time delay circuit means after the time delay to bias the first reference signal to an abnormally high absolute value when said monitoring means produces an output signal indicative of a counterclockwise direction of rotation of the drum means and to bias the second reference signal to an abnormally high absolute value when said monitoring means produces an output signal indicative of a clockwise direction of rotation of the drum means, and to hold the first or second reference signal at such abnormally high absolute value during the continuation of the downstroke and a new upstroke of the polish rod to prevent reactuation of the first or second comparator, respectively, during continued rotation of said drum means in the same direction and until the direction of rotation is reversed again.

14. A long stroke, well pumping unit comprising a base platform; a tower on the base platform; rotatable winding drum means on the base platform; power means to rotate the drum means; a flexible lift belt attached at one end to the drum means and at its other end to the polish rod of a pump; a freely rotatable crown spool mounted atop the tower, the belt being trained over the spool; a freely rotatable idler spool mounted on the base platform at the base of the tower, the belt being trained under the idler spool; a counterweight attached to that portion of the lift belt between the crown spool and the idler spool; means for reversing the power means, thus to cyclically wind and unwind the belt from the winding drum thereby to impart reciprocating movement to the polish rod of a pump, and for adjusting the length of stroke of the polish rod; said reversing means including rotary motion transmission means responsive to rotation of the winding drum, a three position electrical limit switch, and means responsive to said transmission means to actuate said limit switch to one of two operative positions, a first position in which the power means is energized to rotate the winding drum means in a counterclockwise direction and a second position in which the power means is energized to rotate the winding drum means in a clockwise direction, the third position being a neutral or power off position in which the limit switch is in an unactuated condition, and said actuating means being adjustable to return the limit switch to the unactuated third position for a predetermined dwell or rest period between reversals of the power means when a desired length of stroke is completed, thereby normally to deenergize the power means for duration of the dwell period, and to maintain the limit switch in one of the first or second operative positions at all other times; and velocity control means operative during the predetermined dwell period for re-energizing the power means when the polish rod reaches a predetermined velocity in the downstroke of the pumping unit, said velocity control means including a tachometer driven by the drum means and producing an electrical voltage signal which varies proportionately with speed and is of opposite polarity depending upon the direction of rotation of the drum means, an electrical comparator circuit responsive to the voltage signal of the tachometer and including a first comparator responsive to a negative voltage signal from the tachometer indicative of counterclockwise rotation of the drum means, means for producing a negative voltage reference signal indicative of a predetermined speed of rotation of the winding means in the counterclockwise direction, a second comparator responsive to a positive voltage signal of the tachometer indicative of clockwise rotation of the drum means, means for producing a positive voltage reference signal indicative of a predetermined speed in the clockwise direction, said first comparator being actuated to re-energize the power means to drive the drum means in a counter-clockwise direction when the tachometer voltage output signal matches the negative reference signal and said second comparator being actuated to re-energize the power means to drive the drum means in a clockwise direction when the tachometer voltage output signal matches the positive reference signal, a first feed back circuit means responsive to the output signal of the first comparator to bias the negative voltge reference signal to a lesser absolute value upon actuation of the first comparator, a second feed back circuit means responsive to the output signal of the second comparator to bias the positive voltage reference signal to a lesser absolute value upon actuation of the second comparator, whereby each of said first or second comparators, once actuated, is held in an actuated condition for a predetermined period of time sufficient to allow the limit switch of the reversing mechanism to be actuated to the first or second position, respectively, and secondary biasing circuit means responsive to the tachometer voltage signal and including time delay circuit means for delaying response following reversal of the direction of rotation of the drum means for a predetermined period of time sufficient to allow said first or second comparator to be actuated and re-energize the power means in the corresponding direction of rotation, and means responsive to the time delay circuit means after the time delay to bias the negative reference signed to and hold an abnormally high negative voltage when the tachometer output voltage signal is negative and to bias the positive reference signal to and hold an abnormally high positive voltage when the tachometer output voltage signal is positive, thereby to prevent re-actuation of the respective comparator once actuated until the direction of rotation of the winding drum is reversed again.

* * * * *